United States Patent [19]

Gömann et al.

[11] Patent Number: 4,489,534

[45] Date of Patent: Dec. 25, 1984

[54] APPARATUS FOR FILLING TRAYS WITH CIGARETTES OR THE LIKE

[75] Inventors: Rolf Gömann, Dassendorf; Lothar Krause, Hamburg, both of Fed. Rep. of Germany

[73] Assignee: Hauni-Werke Körber & Co. KG, Hamburg, Fed. Rep. of Germany

[21] Appl. No.: 503,701

[22] Filed: Jun. 13, 1983

Related U.S. Application Data

[63] Continuation of Ser. No. 232,252, Feb. 6, 1981, abandoned.

[30] Foreign Application Priority Data

Feb. 12, 1980 [DE] Fed. Rep. of Germany ..... 3005079

[51] Int. Cl.[3] ..... B65B 19/04

[52] U.S. Cl. ..... 53/151; 53/236; 53/245; 221/200

[58] Field of Search ..... 53/236, 245, 255, 260, 53/151, 148, 150, 444, 535; 221/93, 200, 225

[56] References Cited

U.S. PATENT DOCUMENTS

| | | | |
|---|---|---|---|
| 2,821,828 | 2/1958 | Kernen | 53/245 |
| 2,826,883 | 3/1958 | Pollman | 53/236 |
| 2,919,529 | 1/1960 | Hillman | 53/245 X |
| 3,000,161 | 9/1961 | Horgan | 53/255 X |
| 3,241,286 | 3/1966 | Dearsley | 53/236 X |
| 3,320,717 | 5/1967 | Molins et al. | 53/236 X |
| 3,774,370 | 11/1973 | Fried | 53/255 |
| 4,096,938 | 6/1978 | Payne | 53/151 X |
| 4,207,720 | 6/1980 | Tolasch et al. | 53/236 X |

*Primary Examiner*—Horace M. Culver
*Attorney, Agent, or Firm*—Peter K. Kontler

[57] ABSTRACT

Apparatus for filling trays with cigarettes has a magazine which contains a supply of parallel cigarettes and the lower end portion of which extends into the interior of an empty tray so that the lower end portions of several vertical ducts in the lower end portion of the magazine are closely adjacent to the bottom wall of the tray. The tray is lowered continuously or stepwise while the ducts admit vertical streams or rows of cigarettes into the interior of the tray wherein the deposited cigarettes form superimposed layers with the cigarettes of each upper layer staggered relative to the cigarettes of the layer therebelow. This is attributed to the provision of horizontal shafts or horizontal tongues which flank the lower end portions of the ducts and are movable back and forth from neutral positions to effect a desirable distribution of descending cigarettes in the tray. The magazine is further provided with upper wall members which are normally disposed above the horizontal shafts or tongues and each of which can perform several movements to prevent bridging of cigarettes in the magazine, to promote the filling of ducts with cigarettes and/or to seal the lower end portions of the ducts preparatory to replacement of a filled tray with an empty tray.

16 Claims, 3 Drawing Figures

APPARATUS FOR FILLING TRAYS WITH CIGARETTES OR THE LIKE

This application is a continuation of application Ser. No. 232,252 filed Feb. 6, 1981 and now abandoned.

BACKGROUND OF THE INVENTION

The present invention relates to improvements in apparatus for filling receptacles in the form of trays or chargers with rod-shaped articles of the tobacco processing industry, especially for introducing plain or filter tipped cigarettes or filter rod sections into receptacles (hereinafter called trays) which are used for temporary storage and transport of stacked rod-shaped articles to further processing stations. More particularly, the invention relates to improvements in apparatus of the type wherein a magazine has a lower end portion or outlet portion with a plurality of article-discharging ducts for transfer of articles into the interior of a tray and wherein the tray moves relative to the magazine and/or vice versa in order to enable the tray to accept and confine successive layers of articles.

It is well known to fill trays with layers of cigarettes or analogous rod-shaped articles by admitting one layer after the other and by shifting the tray and/or the layer during introduction of the layer into the tray so that the articles of the incoming layer are staggered with reference to the articles of the layer therebelow. Such mode of filling trays is quite satisfactory as regards the distribution of articles in the interior of a filled tray. However, the outlay for machinery which assembles successive layers and transfers the thus assembled layers into trays is considerable. Furthermore, the operation is relatively slow, especially for a plant which employs high-speed processing machines whose consumption is extremely high. Therefore, many of the just mentioned conventional tray filling apparatus are already replaced with apparatus wherein a magazine discharges several continuous streams of rod-shaped articles into a tray which continuously descends in the course of the filling operation. Such apparatus can fill trays within shorter intervals of time; however, the likelihood of misalignment of articles in the interior of a tray and/or the likelihood of the development of gaps between certain articles in the tray is much greater than if the trays are filled in stepwise fashion, i.e., by introduction of successive layers under highly controlled and predictable circumstances. The preferred mode of filling trays with rod-shaped articles is that according to which the array of articles in the filled tray constitutes a so-called quincunx formation, i.e., wherein the articles of each upper layer are staggered with reference to the articles of the layer therebelow so that each article of the upper layer rests in a valley between two neighboring articles of the lower layer. This ensures highly economical utilization of the space in the interior of the tray as well as the formation of a stable stack. Absence of uniformity as regards the distribution of articles in a filled tray is undesirable for several reasons including the likelihood of damage to articles if one or more articles lie askew and particularly fluctuations in the quantities of articles which are admitted to a processing machine as a result of evacuation of the contents of successive filled trays into such machine. Thus, the supply of articles in the processing machine is likely to fluctuate within an undesirably wide range if the quantity of articles in a preceding tray greatly exceeds the quantity of articles in the next-following tray or vice versa.

An apparatus which assembles layers of rod-shaped articles prior to transfer of such layers into a tray is disclosed, for example, in commonly owned U.S. Pat. No. 3,662,880 granted May 16, 1972 to Kochalski et al. An apparatus which can discharge a plurality of continuous streams of rod-shaped articles into a continuously or stepwise descending tray is disclosed in commonly owned U.S. Pat. No. 4,207,720 granted June 17, 1980 to Gerhard Tolasch et al. The disclosure of the patent to Tolasch et al. is incorporated herein by reference. Note should be taken of German Offenlegungsschrift No. 2,803,317.

OBJECTS AND SUMMARY OF THE INVENTION

An object of the invention is to provide a novel and improved apparatus for uniformly and predictably filling chargers, trays or analogous receptacles with elongated rod-shaped articles which constitute or form part of smokers' products.

Another object of the invention is to provide an apparatus which is constructed and assembled in such a way that it can fill successive trays without the formation of gaps in the stacks or arrays of rod-shaped articles which are deposited in the trays.

A further object of the invention is to provide an apparatus which is capable of uniformly and predictably filling trays while the trays are lowered at a constant speed or at frequent intervals to accumulate a succession of superimposed layers of densely packed parallel rod-shaped articles.

An additional object of the invention is to provide a novel and improved magazine for use in an apparatus of the above outlined character.

Another object of the invention is to provide the magazine with novel and improved means for uniformly filling successive trays regardless of potential differences between the dimensions of successive trays.

An additional object of the invention is to provide the magazine with a novel and improved outlet which discharges rod-shaped articles from a supply into the interior of an empty or partially filled tray.

Still another object of the invention is to provide novel and improved drive means for the mobile components of the above outlined magazine.

An ancillary object of the invention is to provide the magazine with novel and improved means for ensuring the distribution of articles in predictable quincunx formations.

A further object of the invention is to provide an apparatus which can be used for filling of conventional trays and which can be used to transfer or introduce plain or filter cigarettes or filter rods into trays of any presently known size and/or shape.

The invention resides in the provision of an apparatus for admitting cigarettes or analogous rod-shaped articles into trays of the type having a bottom wall and additional walls extending upwardly from the bottom wall. The apparatus comprises a pair of vertical chain conveyors or other suitable means for lowering a tray which is to be filled with parallel articles from a raised or upper end position to a lower position (the conveyors can be designed to continuously lower the tray or to lower the tray at given intervals), and a magazine which stores a supply of parallel rod-shaped articles and has an outlet portion which is located at its lower end (below the supply) and is disposed in the interior of and close to the bottom wall of a tray which is held in the raised position. The outlet portion of the magazine has a plurality of preferably upright or nearly upright ducts for admission of articles from the supply into the interior of that tray into which the outlet portion extends and first wall members which are adjacent to the lower end portions of the ducts. The apparatus further comprises drive means (e.g., a crank drive) for imparting to the first wall members recurrent back-and-forth movements transversely of the direction of advancement of articles through the ducts. The back-and-forth movements cause the first wall members to engage the sides of articles which descend in the ducts and to impart to each article at least one movement which is superimposed upon the downward movement of the respective article.

If the ducts are vertical or nearly vertical, the drive means can be designed to move the first wall members in substantially horizontal planes. If the first wall members are downwardly extending tongues which flank the lower end portions of the respective ducts, the drive means can comprise parallel horizontal shafts for the upper portions of the tongues and means for rotating the shafts back and forth to thereby cause the tongues to perform wiping movements which are transmitted to the descending articles and cause proper distribution of articles in the interior of the descending tray.

It is preferred to mount the first wall members on common holder means, and such holder means can be moved back and forth by the drive means, e.g., through the medium of two parallel arms whose lower end portions are turnable about fixed axes and whose upper end portions are articulately connected to the holder means.

The magazine further comprises second wall members, e.g., in the form of rotatable horizontal rods which are parallel to each other and to the first wall members. The second wall members are normally adjacent to the upper end portions of the ducts and can perform a plurality of movements including an angular movement about their respective axes to agitate the articles in the lower portion of the supply, swinging back-and-forth movements transversely of the upper end portions of the respective ducts to ensure that the ducts are always filled with descending articles, and movements into the spaces between the nearest pairs of first wall members to thereby seal the lower end portions of the ducts and prevent further evacuation of articles from the magazine during removal of a filled tray and advancement of a fresh (empty) tray to the aforementioned raised position. The first wall members are preferably movable to and from predetermined median or neutral positions in which they cannot interfere with the movement of second wall members into the lower end portions of the ducts. The drive means then comprises a roller or other suitable means for arresting the first wall members in the median or neutral positions in response to movement of the second wall members into the lower end portions of the ducts.

It is further possible to agitate or reciprocate at least one side wall of the magazine, namely, a side wall which is adjacent to the respective outermost duct in the outlet portion of the magazine. The means for agitating may comprise a crank drive which imparts to the respective side wall of the magazine a recurrent movement to further enhance predictable descent of articles from the supply into a tray which is being filled with rod-shaped articles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
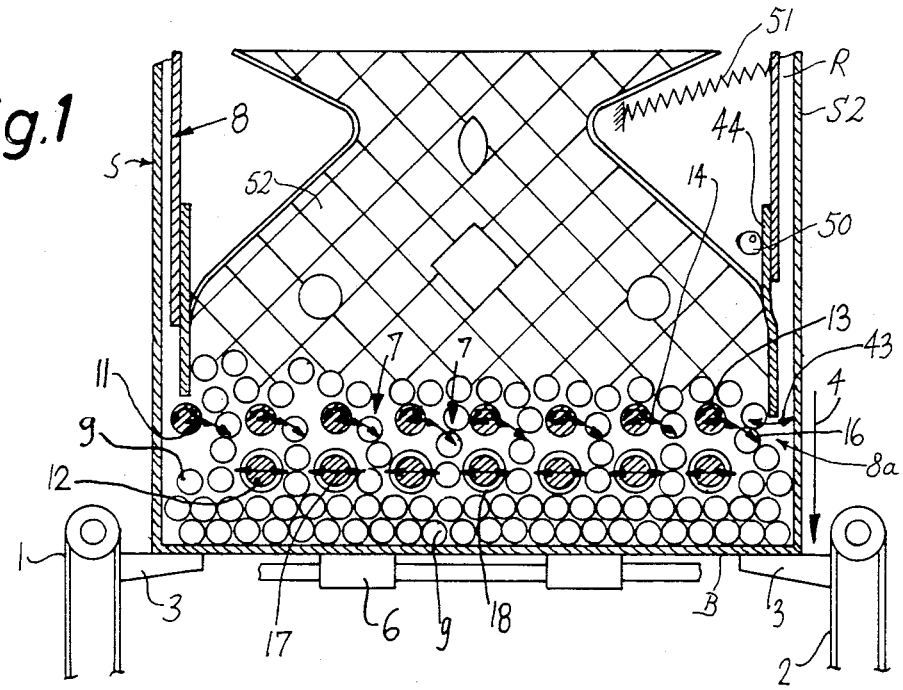
FIG. 1 is a fragmentary vertical sectional view of an apparatus which embodies one form of the invention, and further showing a tray which is lowered during filling with rod-shaped articles.

The tray S of FIG. 1 has a bottom wall B, a rear wall R, and two side walls S1 and S2. The front side of the tray S can remain open. Such trays are widely used in tobacco processing plants for the transport of rod-shaped articles including plain or filter cigarettes, cigars, cigarillos and filter rod sections. The rod-shaped articles 9 which are fed into the tray S of FIG. 1 are assumed to be filter cigarettes. The bottom wall B of the tray S rests on the aligned carriers 3 of two endless vertical conveyors 1 and 2 (e.g., chains) which are driven, either stepwise or continuously, to lower the tray S in the direction indicated by an arrow 4. FIG. 1 shows the tray S in the raised or upper end position. The means for delivering empty trays into the range of the vertical conveyors 1 and 2 comprises a horizontal conveyor 6 which advances empty trays at right angles to the plane of FIG. 1 until an empty tray reaches and comes to rest on two aligned carriers 3. The tray S is thereupon lowered in the direction of the arrow 4 and, when filled, comes to rest on a second horizontal conveyor (not shown) which is similar to the conveyor 6 and serves to remove filled trays by transporting them at right angles to the plane of FIG. 1 so that the bottom walls B of filled trays S move beyond the corresponding carriers 3 of the vertical conveyors 1 and 2. The details of conveyors which transport empty trays, which lower the trays during filling, and which remove filled trays are disclosed in the aforementioned commonly owned U.S. Pat. No. 4,207,720 to Tolasch et al.

As shown in FIG. 1, the tray S contains two complete layers or rows of cigarettes 9. The lower row rests directly on the upper side of the bottom wall B, and the upper row rests on the lower row but its cigarettes 9 are staggered with reference to the cigarettes therebelow. This is the aforediscussed guincunx formation which ensures predictable and dense filling of each of a long series of successive trays. As mentioned above, the front side of the tray S is preferably open; this renders it possible to deliver an empty tray in such position that its side walls s1 and S2 partially confine the corresponding side walls of a magazine 8 which contains a supply 52 of cigarettes 9 and serves to continuously fill the tray S without it being necessary to accumulate discrete layers outside of the tray.

The lower end portion or outlet 8*a* of the magazine 8 is adjacent to but spaced apart from the bottom wall B of the tray S, and such lower end portion is formed with several elongated parallel vertical passages or ducts 7 each of which defines a path for the transfer of cigarettes 9 from the supply 52 in the upper part of the magazine 8 into the interior of the continuously or stepwise descending tray S. The upper portions of the ducts 7 are defined by a row of parallel upper wall members 11 each of which is a horizontal rod and each of which is normally disposed above a lower wall member 12. The lower wall members 12 are elongated rods which are parallel to each other as well as to the wall members 11 (see also FIG. 2) and flank the lower end portions of the respective ducts 7.

The upper wall members 11 perform angular back-and-forth movements about their respective axes in a manner as disclosed in the aforementioned commonly owned U.S. Pat. No. 4,207,720 to Tolasch et al. The directions in which the wall members 11 rotate about their own axes during transfer of cigarettes 9 from the supply 52 in the interior of the magazine 8 into the tray S are indicated by double-headed arrows 13. The aforementioned commonly owned patent also discloses suitable mechanisms which can impart such movements to the upper wall members 11. The angular movements of the upper wall members 11 about their respective axes reduce the likelihood of unsatisfactory filling of successive trays S because such movements reduce the likelihood of bridging of cigarettes 9 in the regions above the upper end portions of the ducts 7 and promote predictable flow of vertical streams or rows of cigarettes 9 into the ducts 7 between the wall members 11. In other words, oscillatory movements of upper wall members 11 about their respective axes are intended to guarantee that each and every duct 7 is continuously filled with cigarettes 9 which, in turn, guarantees predictable formation of layers in the interior of the tray S at the filling station.

In addition to the just discussed oscillatory movements (arrow 13), the upper wall members 11 continuously perform swinging back-and-forth movements in the directions indicated by double-headed arrows 14. These movements are relatively short and their primary purpose is to further reduce the likelihood of or to totally prevent bridging of cigarettes 9 in the regions above the ducts 7. The aforementioned Pat. No. 4,207,720 to Tolasch et al. discloses the means which cause the upper wall members 11 to perform reciprocatory or swinging movements in the directions indicated by the arrow 14.

When a tray S is filled with cigarettes 9, it must be rapidly replaced with an empty tray. During the interval which elapses between the start of removal of a filled tray and termination of introduction of an empty tray to the raised position of FIG. 1, the magazine 8 must be prevented from discharging any cigarettes 9, i.e., the ducts 7 must be temporarily sealed without damaging the cigarettes in the magazine 8 and/or in the uppermost portion of a filled tray S. The upper wall members 11 constitute the means for temporarily sealing the ducts 7 during replacement of a filled tray with an empty or fresh tray S. To this end, the upper wall members 11 are movable in directions which are indicated by the arrows 16 (these arrows constitute extensions of the arrows 14) so that they enter the spaces between the lower wall members 12 and thereby seal the lower end portions of the ducts 7 against the passage of cigarettes 9 therethrough. The movement of upper wall members 11 in the directions which are indicated by the arrows 16 takes place in the general direction of movement of cigarettes 9 through the ducts 7 under the action of gravity as well as in response to the force which is applied by the cigarettes 9 thereabove. The aforementioned U.S. Pat. No. 4,207,720 discloses suitable means for moving the upper wall members 11 in the directions indicated by the arrows 16, i.e., for moving the wall members 11 to and from the positions in which the lower end portions of the ducts 7 are sealed.

Figure 2:
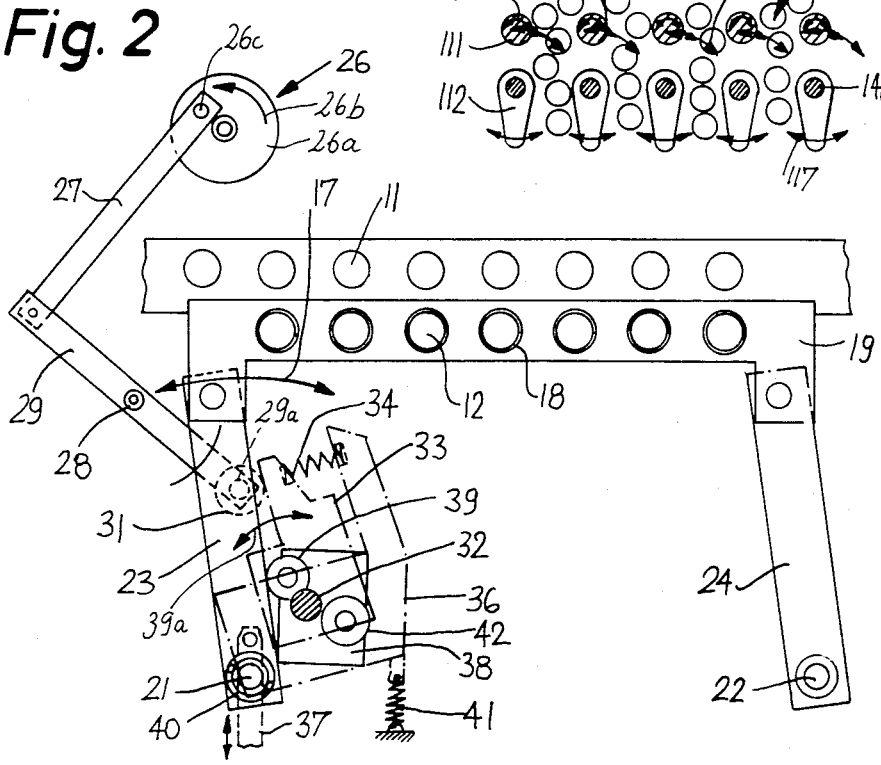
FIG. 2 is a front elevational view of the mechanism which imparts movements to the lower wall members in the outlet of the magazine shown in FIG. 1.

It will be noted that the mobile upper wall members 11 perform several important functions including defining the upper end portions of the ducts 7 (by being normally disposed above the nearest lower wall members 12), ensuring continuous filling of ducts 7 with cigarettes 9 (rotary movements indicated by the arrows 13), preventing bridging of cigarettes 9 in the magazine 8 in the region above the ducts 7 (swinging movements in the directions indicated by arrows 14), and (when necessary) sealing the ducts 7 in cooperation with the lower wall members 12 (movements in the directions indicated by arrows 16). In accordance with a feature of the invention, the lower wall members 12 also perform predetermined movements, primarily for the purpose of ensuring that the cigarettes 9 which enter the tray S therebelow form arrays which constitute the aforediscussed quincunx formations and that the cigarettes fill the entire tray S which is in the process of receiving cigarettes 9 without permitting the development of gaps as a result of the formation of incomplete layers and without permitting certain cigarettes to lie askew. In other words, each and every cigarette 9 which forms part of a row other than the lowermost row must descend into and come to rest in a recess or groove defined by two neighboring cigarettes of the layer therebelow. The development of satisfactory quincunx formations in each and every zone of a tray S which is being filled can be ensured by imparting to the lower wall members 12 movements in the directions indicated by double-headed arrows 17, namely, recurring back-and-forth movements in a substantially horizontal plane and at right angles to the axes of the normally rod-shaped lower wall members 12 as well as substantially at right angles to the longitudinal directions of the ducts 7. The means for imparting such recurrent back-and-forth movements to the lower wall members 12 is illustrated in FIG. 2. These wall members are secured to an elongated strip-shaped holder 19 which is articulately connected to the upper end portions of two parallel arms 23, 24 and these arms are respectively pivotable about the axes of two fixed horizontal shafts 21 and 22 mounted in the frame of the tray filling apparatus. Each lower wall member 12 preferably carries one or more freely rotatable sleeves 18 having spherical or substantially spherical external surfaces for the purposes described in the aforementioned U.S. Pat. No. 4,207,720. The holder 19 is located behind the magazine 8, as viewed in FIG. 1, and is caused to move the wall members 12 back and forth (see the arrows 17 in FIG. 2) by a crank drive 26 including a disc 26*a* which is driven by a motor (not shown) to rotate in the direction of arrow 26*b*, an eccentric crank pin 26*c* on the disc 26*a*, a first link 27 which is mounted on the crank pin 26*c* and a second link 29 which is pivotable about the axis of a fixed horizontal shaft 28. The link 29 is actually a two-armed lever one arm of which is articulately connected to the lower end portion of the link 27 and the other end portion of which carries a roller 31 mounted on a pin 29*a*. The roller 31 contacts a pivotable lever 33 which is secured to a rotatable horizontal shaft 32 and is biased against the roller 31 by a helical spring 34. The latter reacts against a retainer 36 which is also rotatable with the shaft 32 and is normally held in the illustrated operative position by a vertically reciprocable rod 37 which constitutes or is connected with the armature of an electromagnet (not shown) of the type disclosed in the aforementioned U.S. Pat. No. 4,207,720. The shaft 32 further supports a block-shaped support 38 for a roller 39 which bears against the arm 23 and causes the holder 19 to move back and forth (arrow 17 in FIG. 2) in response to pivoting of the lever or link 29 forming part of the crank drive 26. The directions in which the arm 23 pivots back and forth under the action of the roller 39 are indicated by the double-headed arrow 39*a* shown in FIG. 2. A torsion spring 40 on the shaft 21 biases the arm 23 clockwise, as viewed in FIG. 2, so as to ensure that the arm 23 normally bears against the roller 39 on the support 38. The spring 40 urges the arm 23 clockwise, as viewed in FIG. 2, and the roller 39 intermittently moves the arm 23 in a counterclockwise direction against the opposition of the spring 40.

When the upper wall members 11 move to the arresting or blocking positions (arrows 16 in FIG. 1) so as to enter into the spaces between the neighboring lower wall members 12, the lower wall members 12 are arrested (i.e., they are held against further movement in the directions indicated by arrows 17) in response to deenergization of the electromagnet for the armature 37. This enables a helical spring 41 to pivot the retainer 36 in a clockwise direction, as viewed in FIG. 2, whereby the retainer 36 turns the shaft 32 in the same direction and the shaft 32 turns the support 38 which moves the roller 39 away from the arm 23. At the same time, the support 38 (which turns in a clockwise direction, as viewed in FIG. 2, under the action of the spring 41) moves a further roller 42 into engagement with the arm 23 to arrest the lower wall members 12 in median or neutral positions, namely, in positions in which the wall members 12 cooperate with the wall members 11 to prevent the escape of cigarettes 9 from the magazine 8 via ducts 7.

The aforediscussed movements of the upper wall members 11 in the directions of arrows 13 and/or 14 and the movements of the lower wall members 12 in the directions indicated by arrows 17 can be synchronized in such a way that the wall members 11 and 12 move in the same direction or in the opposite directions.

The left-hand and/or the right-hand side wall 44 of the magazine 8 can be said to form part of the nearest (outermost) duct 7. In order to further enhance desirable arraying of cigarettes 9 in the tray S, such side walls of the magazine 8 can be caused to perform movements which resemble the movements of the wall members 11 and/or 12. For example, at least one of the side walls 44 (e.g., the right-hand side wall of FIG. 1) can be moved back and forth in the directions indicated by a double-headed arrow 43. This movement is analogous to the movement of the adjacent upper wall members 11 in the directions indicated by the arrow 14. The movements of the one and/or other side wall 44 can compensate, for example, for differences in the dimensions of successive trays S. The means for imparting to the right-hand side wall 44 movements in directions indicated by the arrow 43 may comprise any suitable drive, e.g., an eccentrically mounted disc 50 which is rotated by a motor (not shown) and a spring 51 which pulls the right-hand side wall 44 against the disc 50.

Figure 3:
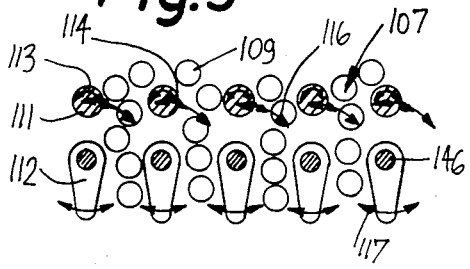
FIG. 3 is a fragmentary vertical sectional view of a modified apparatus.

FIG. 3 shows a portion of a modified tray filling apparatus wherein all such parts which are identical with or clearly analogous to the corresponding parts of the apparatus shown in FIGS. 1 and 2 are denoted by similar reference characters plus 100. The main difference between the two apparatus is that the lower wall members 112 of FIG. 3 are downwardly extending tongues which are rotatable back and forth (arrow 117) by parallel horizontal shafts 146. The axes of the shafts 146 are stationary. The means for rotating the shafts 146 back and forth through desired angles is preferably identical with or similar to the aforediscussed means for oscillating the wall members 11 about their respective axes (arrow 13 in FIG. 1) and is disclosed in the aforementioned U.S. Pat. No. 4,207,720. When the shafts 146 are driven, the tongue-like lower wall members 112 perform wiping back-and-forth movements to thereby further enhance predictable and uniform distribution of cigarettes 109 in the interior of the tray (not shown in FIG. 3), i.e., to even more reliably ensure that each cigarette 109 which forms part of the second lowermost or any higher layer invariably descends into the gap or valley between two neighboring cigarettes 109 of the layer therebelow.

An important advantage of the improved apparatus is that it ensures more predictable and denser stacking of cigarettes or analogous rod-shaped articles in chargers, trays or analogous receptacles. This is attributable to the provision of mobile lower wall members 12 or 112 which distribute the descending articles 9 or 109 in the interior of a stepwise or continuously descending tray so that the stack of articles in the interior of the tray is devoid of gaps and the articles are much less likely to lie askew. The back-and-forth movements of the wall members 12 or 112 are superimposed upon the downward movement of articles 9 or 109 in the respective ducts 7 or 107. The downwardly extending tongue-like wall members 112 of FIG. 3 are especially likely to effect uniform spreading of articles 109 in the interior of the tray so that the tray accumulates predictable layers each of which contains a predetermined number of closely adjacent parallel articles 109. The movements of the wall members 112 resemble those of wipers and are particularly suited to ensure uniform spreading of articles 109 without any damage to such articles during travel through the ducts 107 and/or in the interior of a tray. When held in the median or neutral positions (e.g., by the roller 42 of FIG. 2) the tongue-like wall members 112 preferably extend vertically downwardly so as to allow the associated upper wall members 111 to enter into the lower end portions of the ducts 107 and to thus prevent further discharge of articles 109 from the interior of the magazine whose lower end portion or outlet portion embodies the structure of FIG. 3. The articles which are already located in the ducts 7 or 107 are free to descend into the tray therebelow during movement of the upper wall members 11 or 111 to their lower end positions, i.e., into the lower end portions of the ducts 7 or 107.

It has been found that recurrent movements of the lower wall members 12 or 112 during filling of a tray S are much more likely to ensure gap-free filling of trays than if the lower wall members were stationary.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for admitting cigarettes or analogous rod-shaped articles into trays of the type having a bottom wall and additional walls extending upwardly from the bottom wall, comprising means for lowering a tray which is to be filled from a raised position to a lower position; a magazine arranged to store a supply of parallel articles and having an outlet portion disposed in the interior of and close to the bottom wall of a tray in said raised position, said outlet portion having a plurality of ducts for admission of articles from said supply into the interior of the tray into which said outlet portion extends and first wall members bounding said ducts, said ducts having lower end portions and said first wall members being so closely adjacent to the lower end portions of the respective ducts that the articles which descend beyond said first wall members are disposed at a level below said ducts and encounter no additional obstructions on their way into the tray into which said outlet portion extends; and drive means for imparting to said first wall members recurrent back-and-forth movements transversely of the direction of advancement of articles through said ducts to impart to the descending articles a sidewise movement while the articles advance through said ducts.

2. The apparatus of claim 1, wherein said ducts are substantially vertical and said drive means is operative to move said first wall members in a substantially horizontal plane.

3. The apparatus of claim 1, further comprising common holder means for said first wall members, said drive means including means for moving said first wall members through the medium of said holder means.

4. The apparatus of claim 3, wherein said means for moving comprises arms pivotable about fixed axes and articulately connected with said holder means.

5. The apparatus of claim 1, wherein said first wall members include tongues and said drive means includes means for rotating said tongues back and forth about fixed axes.

6. The apparatus of claim 5, wherein said tongues extend downwardly from the respective fixed axes.

7. The apparatus of claim 1, wherein each of said ducts has an upper end portion and said magazine further includes second wall members normally adjacent to the upper end portions of said ducts and being movable relative to the first wall members.

8. The apparatus of claim 7, wherein all of said wall members are elongated and said first wall members are substantially horizontal, said second wall members being substantially horizontal and parallel to said first wall members and further comprising means for rotating said second wall members back and forth about horizontal axes parallel to said first wall members.

9. The apparatus of claim 8, further comprising means for swinging said second wall members back and forth substantially transversely of said ducts.

10. The apparatus of claim 8, further comprising means for moving said second wall members downwardly between the neighboring first wall members upon completion of filling of a tray so that said second wall members prevent the discharge of articles through the lower end portions of said ducts.

11. The apparatus of claim 10, wherein said first wall members are movable to and from predetermined median positions and said drive means includes means for maintaining said first wall members in said median positions in response to downward movement of said second wall members into the outlet portions of said ducts to thus provide room for downward movement of said second wall members between the neighboring first wall members.

12. The apparatus of claim 1, wherein said drive means comprises a crank drive.

13. The apparatus of claim 1, wherein said magazine has at least one side wall and means for moving said side wall relative to the nearest duct.

14. The apparatus of claim 13, wherein said means for moving said side wall includes a crank drive.

15. The apparatus of claim 1, wherein said first wall members are of identical size and shape and wherein said drive means is arranged to impart to all of said first wall members identical back-and-forth movements substantially transversely of said ducts.

16. The apparatus of claim 1, wherein each of said first wall members comprises an elongated rod and said magazine further comprises at least one sleeve freely rotatable on one of said rods.

* * * * *